US008387971B2

(12) United States Patent
Sunohara

(10) Patent No.: US 8,387,971 B2
(45) Date of Patent: Mar. 5, 2013

(54) MEDIA-LOADED DEVICE AND IMAGE FORMING APPARATUS

(75) Inventor: Takahiro Sunohara, Tokyo (JP)

(73) Assignee: Oki Data Corporation, Tokyo (JP)

( * ) Notice: Subject to any disclaimer, the term of this patent is extended or adjusted under 35 U.S.C. 154(b) by 13 days.

(21) Appl. No.: 13/064,447

(22) Filed: Mar. 25, 2011

(65) Prior Publication Data

US 2011/0233854 A1 Sep. 29, 2011

(30) Foreign Application Priority Data

Mar. 26, 2010 (JP) ..... 2010-073456

(51) Int. Cl.
*B65H 1/00* (2006.01)

(52) U.S. Cl. ..... 271/171

(58) Field of Classification Search ..... 271/171; 27/171
See application file for complete search history.

(56) References Cited

U.S. PATENT DOCUMENTS

| | | | | |
|---|---|---|---|---|
| 6,267,522 | B1 * | 7/2001 | Slippy et al. | 400/708.1 |
| 7,607,657 | B2 * | 10/2009 | Kawarago | 271/171 |
| 2010/0213663 | A1 * | 8/2010 | Kitayama | 271/18 |

FOREIGN PATENT DOCUMENTS

| | | | |
|---|---|---|---|
| JP | 04-191218 | A | 7/1992 |
| JP | 06-032468 | A | 2/1994 |
| JP | 11-139573 | A | 5/1999 |
| JP | 11-222321 | A | 8/1999 |
| JP | 2002-255358 | A | 9/2002 |
| JP | 2008-105819 | A | 5/2008 |
| JP | 2010-006596 | A | 1/2010 |
| JP | 2010-195550 | A | 9/2010 |

* cited by examiner

*Primary Examiner* — Michael McCullough
(74) *Attorney, Agent, or Firm* — Rabin & Berdo, P.C.

(57) ABSTRACT

A media-loaded device includes a main body and a guide unit. The main body, in which media are stackable, has a first engaging member. The guide unit is movable relative to the main body and has a disengaging member. The disengaging member has a second engaging member that engages with the first engaging member. The second engaging member is disengaged from the first engaging member by an external force applied to the disengaging member in a stacking direction of the media.

10 Claims, 16 Drawing Sheets

MEDIA-LOADED DEVICE AND IMAGE FORMING APPARATUS

CROSS-REFERENCE TO RELATED APPLICATION

This application claims priority based on 35 U.S.C. §119 from prior Japanese Patent Application No. P 2010-073456, filed on Mar. 26, 2010, the entire contents of which are incorporated herein by reference.

BACKGROUND OF THE INVENTION

1. Field of the Invention

This application relates to a media-loaded device that is loaded with media for use in an image forming apparatus. This application also relates to the image forming apparatus including the media-loaded device.

2. Description of the Related Art

A media-loaded device includes a main body, a guide, and a lock member. The body is loaded with media in a stack. The guide comes into contact with ends of the media to regulate the position of the media. The lock member is provided at a side of the guide that faces the ends of the media. The lock member secures the guide to the body at a predetermined position corresponding to the size of a medium, and also releases the guide from the body. Japanese Laid-Open Patent No. 2002-255358 discloses one such media-loaded device.

In such a media-loaded device, however, a clearance into which a user can insert fingers is necessary between the lock member and the ends of the media, resulting in an increase in size of a guide unit that includes the guide and the lock member. As a result, the media-loaded device becomes large.

SUMMARY OF THE INVENTION

An object of the application is to disclose a media-loaded device and an image forming apparatus that are capable of preventing them from increasing in size.

According to one aspect, a media-loaded device includes a main body and a guide unit. The main body, in which media are stackable, has a first engaging member. The guide unit is movable relative to the main body and has a disengaging member. The disengaging member has a second engaging member that engages with the first engaging member. The second engaging member is disengaged from the first engaging member by an external force applied to the disengaging member in a stacking direction of the media.

According to another aspect, a media-loaded device includes a main body and a guide unit. The main body, in which media are stackable, has a first engaging member. The guide unit is movable relative to the main body and has a disengaging member. The disengaging member has a second engaging member that engages with the first engaging member. The second engaging member is disengaged from the first engaging member by an external force applied to the disengaging member in any of a plurality of different directions.

According to yet another aspect, a media-loaded device includes a main body and a guide unit. The main body, in which media are stackable, has a first engaging member. The guide unit is movable relative to the main body, and has a regulation member and a disengaging member. The regulation member, which regulates position of the media, has a receiving platform that receives the media thereon, and a contact portion that comes into contact with ends of the media. The disengaging member, which pivots relative to the regulation member, has a second engaging member that engages with the first engaging member, a first member, and a second member that is at a predetermined angle to the first member.

The full scope of applicability of the media-loaded device and the image forming apparatus will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The media-loaded device and the image forming apparatus will become more fully understood from the following detailed description with reference to the accompanying drawings, which are given by way of illustration only, and thus not to limit the invention, and wherein.

DETAILED DESCRIPTION OF THE INVENTION

Preferred embodiments of a media-loaded device and an image forming apparatus according to the invention will be described in detail with reference to the accompanying drawings. In each embodiment, the description will be given with reference to an electrophotographic printer as an image forming apparatus.

First Embodiment

Figure 1:
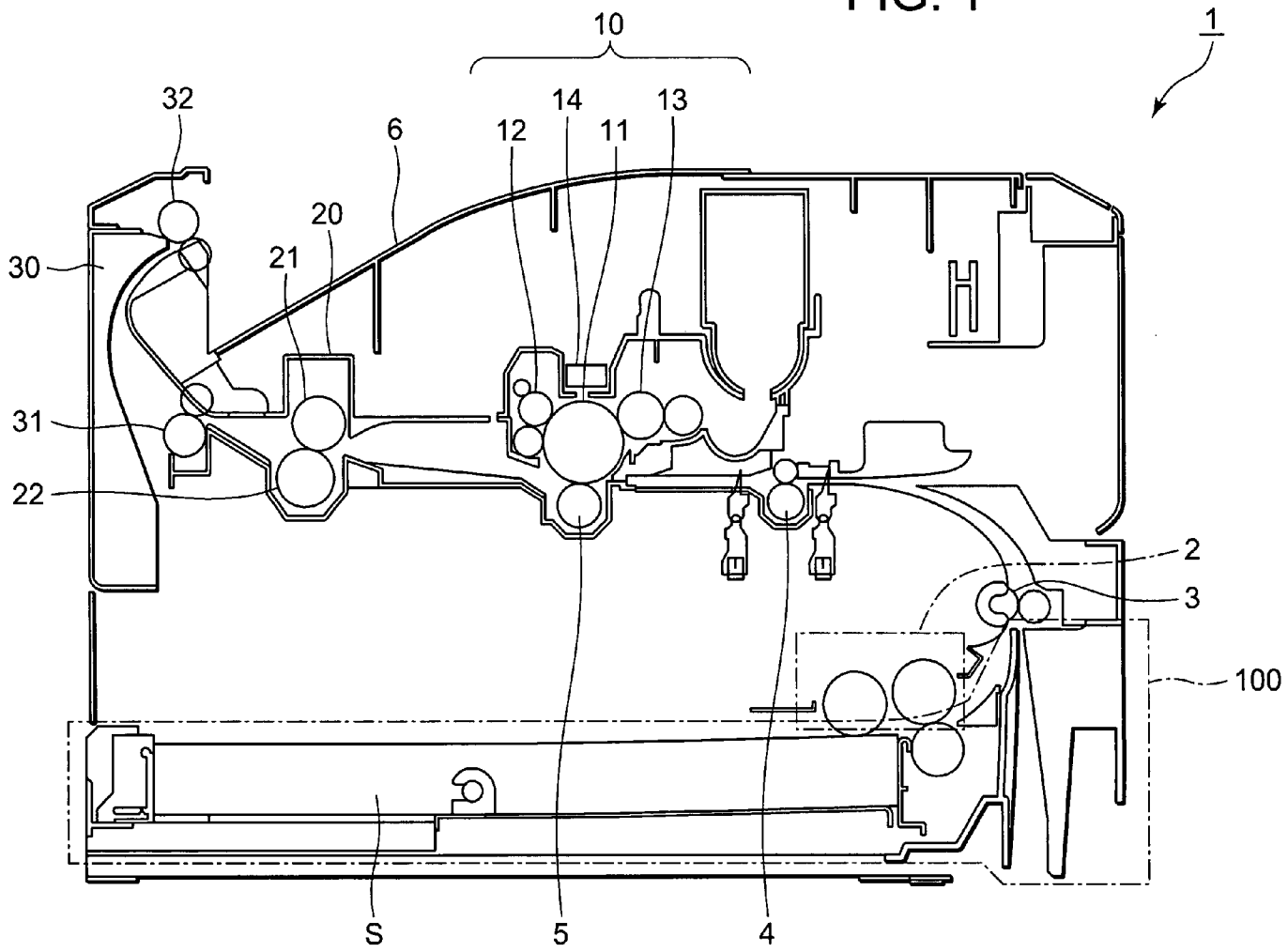
FIG. 1 is a schematic view of an image forming apparatus of a first embodiment.

FIG. 1 is a schematic view of a printer 1 of a first embodiment, which may include a sheet cassette 100, a feeder unit 2, transport rollers 3 and 4, an image-forming unit 10, a transfer roller 5, a fuser unit 20, a discharge unit 30, and a stacker 6.

The printer 1 forms an image on a medium, for example a sheet, by an electrophotographic technique, based on image data sent from an external computer. The cassette 100, which serves as a media-loaded device, is loaded with sheets S in a stack. However, the cassette may be loaded with only one sheet. The feeder unit 2 feeds the sheets one-by-one from the cassette. The transport rollers 3 and 4 transport the fed sheet toward the image-forming unit 10.

The image-forming unit 10 may include a photosensitive drum 11, a charging roller 12, and a developing roller 13. The drum, which serves as an image bearing body, bears an electrostatic latent image, formed using an exposure unit 14, on its surface. The exposure unit may be an LED (Light-Emitting Diode) head in which multiple LED elements are aligned in a direction parallel to a rotational axis of the drum. Alternatively, the exposure unit may be a laser scanner unit, which includes a laser irradiation part and a polygon mirror. The charging roller uniformly charges the surface of the drum. The developing roller develops the latent image on the drum with toner to form a toner image.

The transfer roller 5 transfers the toner image on the drum 11 to the sheet. The fuser unit 20, which may include a heat roller 21 and a pressure roller 22, fixes the transferred toner image onto the sheet with heat and pressure. The discharge unit 30, which may include discharge rollers 31 and 32, delivers the sheet with the fixed toner image thereon to the stacker 6. The stacker is provided on the printer 1 and holds the sheet face down, i.e., with the image-formed side down.

Next, a printing operation of the printer 1 will be described with reference to FIG. 1. When the printing operation is initiated, the feeder unit 2 feeds sheets S in the cassette 100 one-by-one into a sheet path. The transport rollers 3 and 4 transport the fed sheet toward the image-forming unit 10. The transfer roller 5 transfers a toner image formed on the drum 11 to the sheet. The fuser unit 20 fixes the transferred toner image onto the sheet with heat and pressure. The discharge rollers 31 and 32 of the discharge unit 30 deliver the sheet with the fixed toner image thereon to the stacker 6, which holds the sheet face down.

Figure 2:
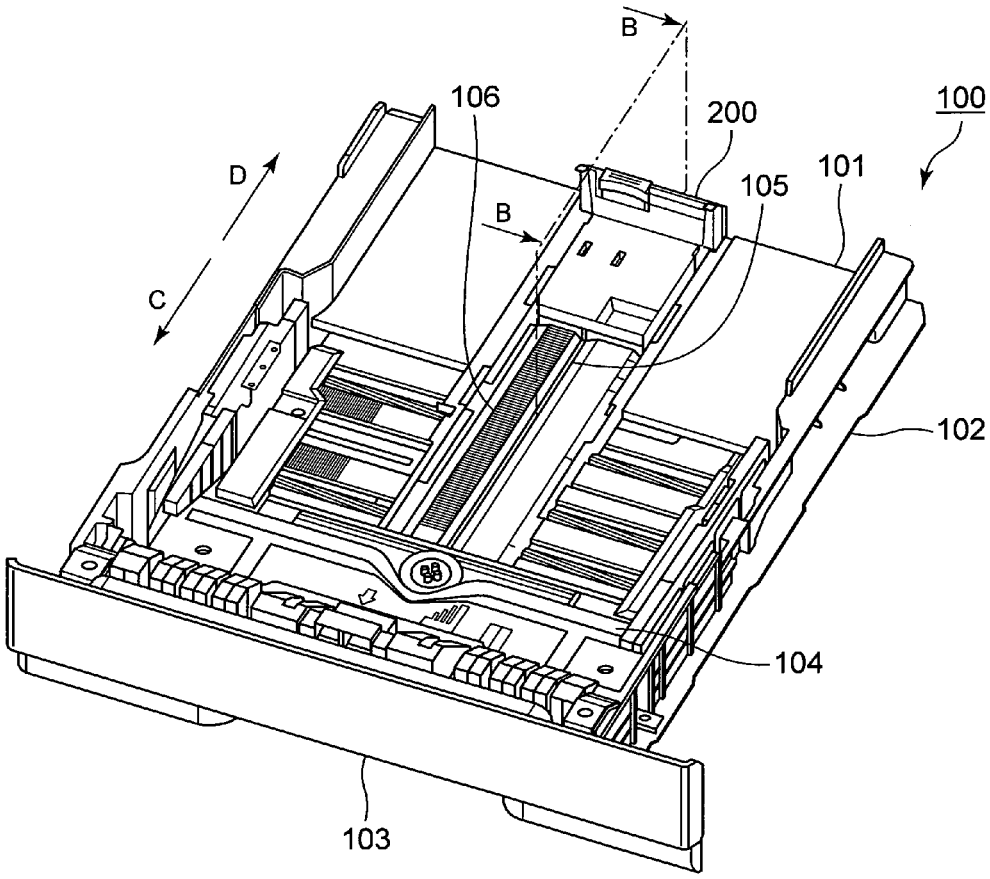
FIG. 2 is a perspective view of a media-loaded device of the first embodiment.

Next, the cassette 100 will be described in detail. FIG. 2 is a perspective view of the cassette, which may include a main body 101, a slider 102, a cover 103, a receiving plate 104, a rib 105, a lock portion 106, and a tail guide unit 200. As shown in FIG. 1, the cassette is mounted to a lower part of the printer 1. In addition, sheets in the cassette are fed in the direction C by the feeder unit 2, as shown in FIG. 2.

The body 101 is an open-topped box in shape so that sheets can be supplied thereto from above. The slider 102 is provided on a side of the body and slidably fits into a rail, not shown, provided in the printer 1. This allows the cassette 100 to be inserted into the printer while sliding in the direction D. The cover 103 is provided at the front of the cassette and makes up a part of a housing of the printer. The receiving plate 104 and the body form a receiving space for receiving sheets. The plate also upwardly presses a downstream side of the sheets in the feed direction (i.e., in the direction C) so that the feeder unit 2 (See, e.g., FIG. 1) can feed the sheets from the cassette.

The rib 105 is provided on an inner bottom surface of the body 101, and extends in the feed direction (i.e., in the direction C). The lock portion 106, which serves as a first engaging member, includes multiple projections, and is provided adjacent to the rib. The lock portion 106 extends in the feed direction so that the tail guide unit 200 can be positioned to accommodate sheets of various sizes. The tail guide unit 200 comes into contact with rear ends of the sheets in the feed direction, and regulates the position of the sheets.

Figure 3:
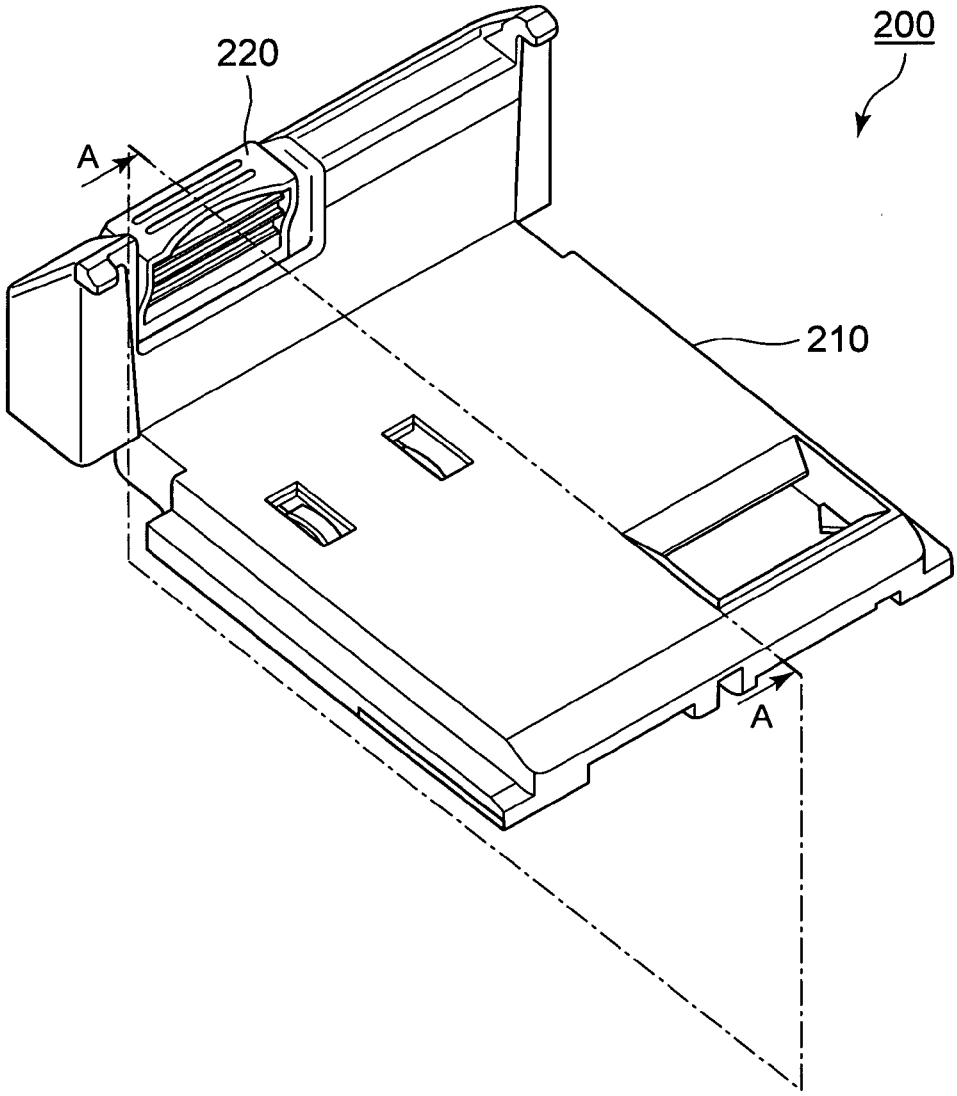
FIG. 3 is a perspective view of a guide unit of the first embodiment.

Next, the tail guide unit 200 will be described in detail. FIG. 3 is a perspective view of the tail guide unit 200, which includes a tail guide 210 and a lock lever 220. The tail guide 210, which serves as a regulation member, comes into contact with rear ends of sheets in the feed direction (i.e., in the direction C in FIG. 2), and regulates the position of the sheets. The lock lever 220, which serves as a disengaging member, secures the tail guide unit 200 to the body 101, and also releases the tail guide unit 200 from the body.

Figure 4:
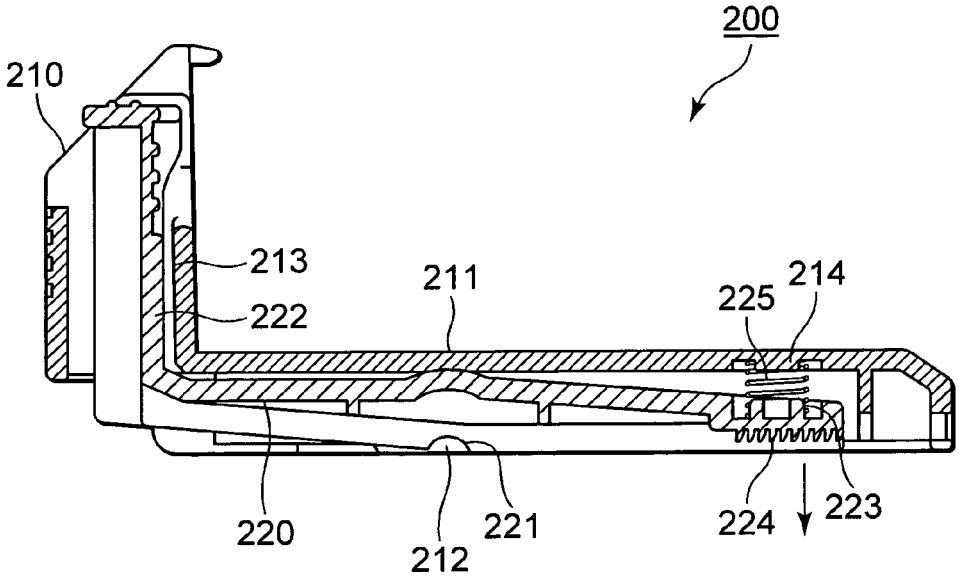
FIG. 4 is a cross-sectional view of the guide unit along a plane A-A in FIG. 3.

FIG. 4 is a cross-sectional view of the tail guide unit 200 along a plane A-A in FIG. 3. As shown in FIG. 4, the tail guide 210 includes a receiving platform 211, a pivot point 212, an inner wall 213, and a spring support 214. The platform receives sheets. The pivot point 212, which is formed below and along the platform, engages with a recess 221 of the lock lever 220 described later. The inner wall 213, which serves as a pivot-restricting member, prevents the lock lever 220 from pivoting beyond necessity. The spring support 214 supports one end of a spring 225, which serves as a pressure member.

The lock lever 220 includes the recess 221, a lever member 222, a spring support 223, and a lock portion 224. The recess engages with the pivot point 212 of the tail guide 210. The lever member 222, which serves as a first member, abuts the inner wall 213 of the tail guide 210. The spring support 223, which supports the other end of the spring 225, is formed at an end of the lock lever 220 that is opposite to an end of the lock lever 220 at which the lever member 222 is formed. The lock portion 224, which serves as a second engaging member, includes multiple projections, and is pressed by the spring 225 in the direction of arrow in FIG. 4, i.e., toward the lock portion 106 of the body 101. The lock lever 220 pivots about the pivot point 212 by a force from the spring 225. As a result, the lever member 222 abuts the inner wall 213 of the tail guide 210.

In the first embodiment, because the lock lever 220 is located between the platform 211 and the pivot point 212, the vertical movement of the lock lever 220 is restricted. In addition, the inner wall 213 of the tail guide 210 prevents the lock lever 220 from pivoting beyond necessity. These features allow the tail guide unit 200 to be in stable condition.

Figure 5A:
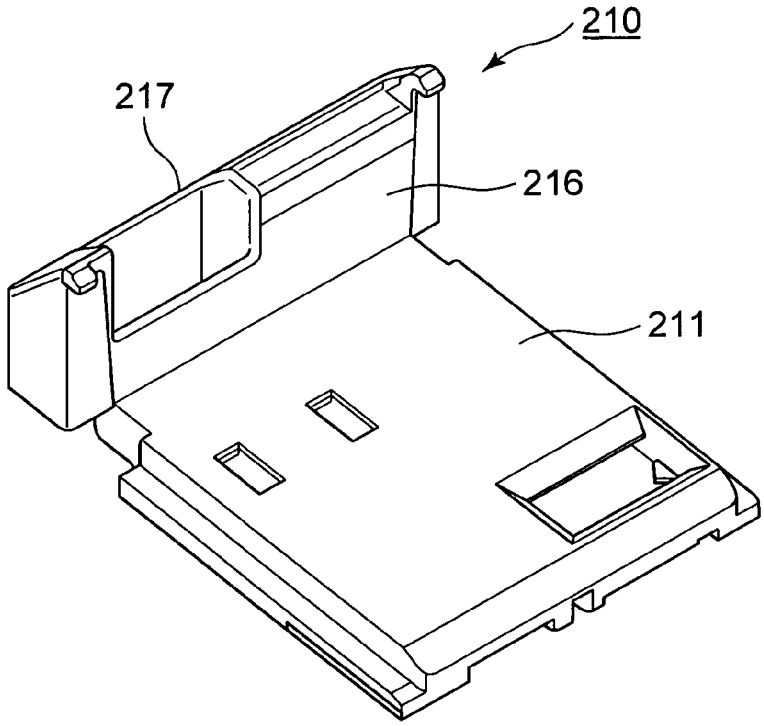
FIG. 5A is a first perspective view of a regulation member of the first embodiment.
Figure 5B:
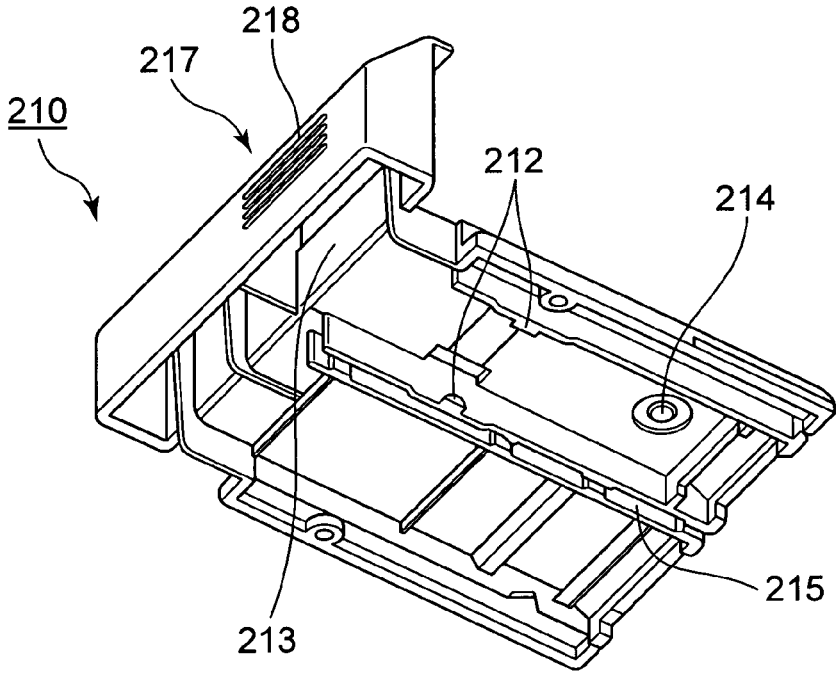
FIG. 5B is a second perspective view of the regulation member of the first embodiment.

FIGS. 5A and 5B are respectively first and second perspective views of the tail guide 210. As shown in FIGS. 5A and 5B, the tail guide 210 includes a groove 215, a contact portion 216, and a handling portion 217 in addition to the platform 211, the pivot point 212, the inner wall 213, and the spring support 214. The groove receives the rib 105 of the body 101 (See, e.g., FIG. 2). The contact portion comes into contact with rear ends of sheets in the feed direction (i.e., in the direction C in FIG. 2), and regulates the position of the sheets. The lever member 222 of the lock lever 220 (See, e.g., FIG. 4) extends along the contact portion. The handling portion 217 is formed on a side opposite to the contact portion. A user can move the tail guide 210 in the direction C or D in FIG. 2 through the handling portion 217. The handling portion 217 has a concave-convex portion 218 that prevents the user's fingers from slipping when he/she handles the tail guide 210.

Figure 6A:
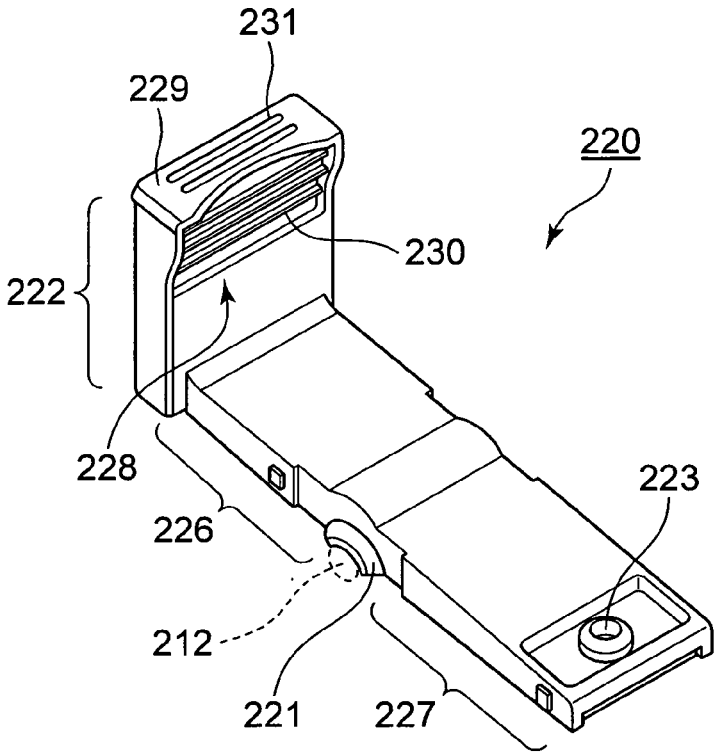
FIG. 6A is a first perspective view of a disengaging member of the first embodiment.
Figure 6B:
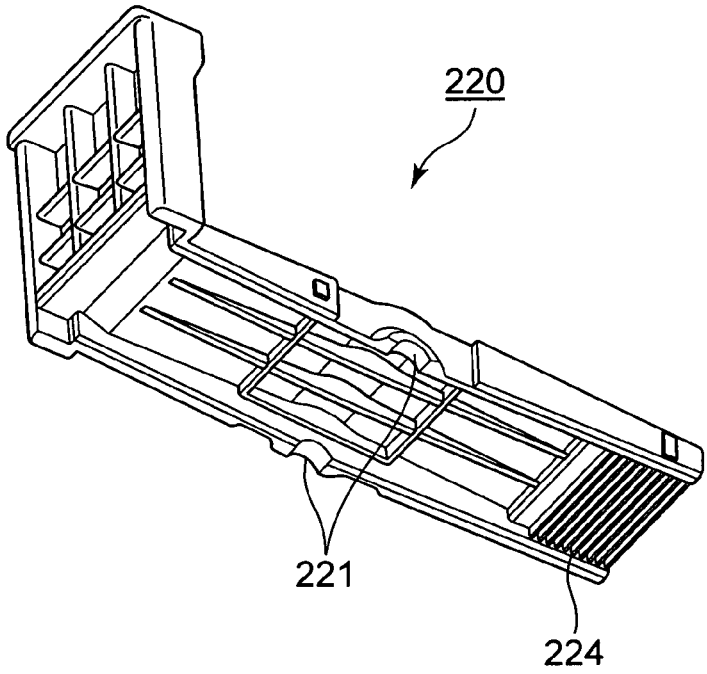
FIG. 6B is a second perspective view of the disengaging member of the first embodiment.

FIGS. 6A and 6B are respectively first and second perspective views of the lock lever 220. As shown in FIGS. 6A and 6B, the lock lever 220 includes a lever member 226, an arm member 227, a side handling portion 228, and an upper handling portion 229 in addition to the recess 221, the lever member 222, the spring support 223, and the lock portion 224. The above-mentioned elements of the lock lever 220 are integrally formed.

The lever member 226, which serves as a second member, extends from the recess 221 to the lever member 222. That is to say, the recess, which engages with the pivot point 212 of the tail guide 210, is formed at one end of the lever member 226, and the lever member 222 is formed at the other end of the lever member 226. The lever member 226 is located between the platform 211 and the pivot point 212 so as to pivot about the pivot point 212 relative to the tail guide 210.

The lever member 226 is at a predetermined angle to the lever member 222. In the first embodiment, the lever member 226 is at substantially a right angle to the lever member 222. However, the angle between the lever members 222 and 226 may be in the range of 70° to 110°. Specifically, assuming that a diameter of a fingertip of an average adult user is 20 mm, and a margin that is provided to allow the finger to move is 5 mm, the guide unit in the related art requires a clearance of about 25 mm between the lock member and sheets. In contrast, in the first embodiment, the tail guide unit 200 can be made more compact than the guide unit in the related art, when the angle between the lever members 222 and 226 is in the range of 70° to 110°, on the condition that the maximum stacking height of sheets in the tail guide unit 200 is about 65 mm. In addition, if the clearance between the lock lever 220 and the sheets needs to be less than half of 25 mm (i.e., less than 12.5 mm), the angle could be in the range of 80° to 100°.

The arm member 227 extends from the recess 221 in a direction away from the lever members 222, and has the lock portion 224 at its end away from the recess.

The handling portions 228 and 229 allow a user to handle the lock lever 220. The handling portions 228 and 229 respectively have concave-convex portions 230 and 231, which prevent the user's fingers from slipping when he/she handles the lock lever 220.

Referring to FIGS. 5A, 5B, 6A and 6B, in the first embodiment, the handling portion 217 of the tail guide 210 and the side handling portion 228 of the lock lever 220 are substantially perpendicular to the direction in which the contact portion 216 comes into contact with rear ends of sheets, i.e., the direction of movement of the tail guide unit 200, and are also substantially parallel to the contact portion. The upper handling portion 229 of the lock lever 220 is substantially parallel to the direction of movement of the tail guide unit 200. That is to say, the upper handling portion 229 is substantially parallel to the platform 211 of the tail guide 210.

As described above, the lever members 222 and 226 lie at substantially right angles to each other. Therefore, a user can efficiently disengage the lock portion 224 of the lock lever 220 from the lock portion 106 of the body 101 by pressing either of the handling portions 228 or 229. In addition, because the upper handling portion 229 is provided on the top surface of the lever member 222, the user can intuitively obtain its location.

Figure 7:
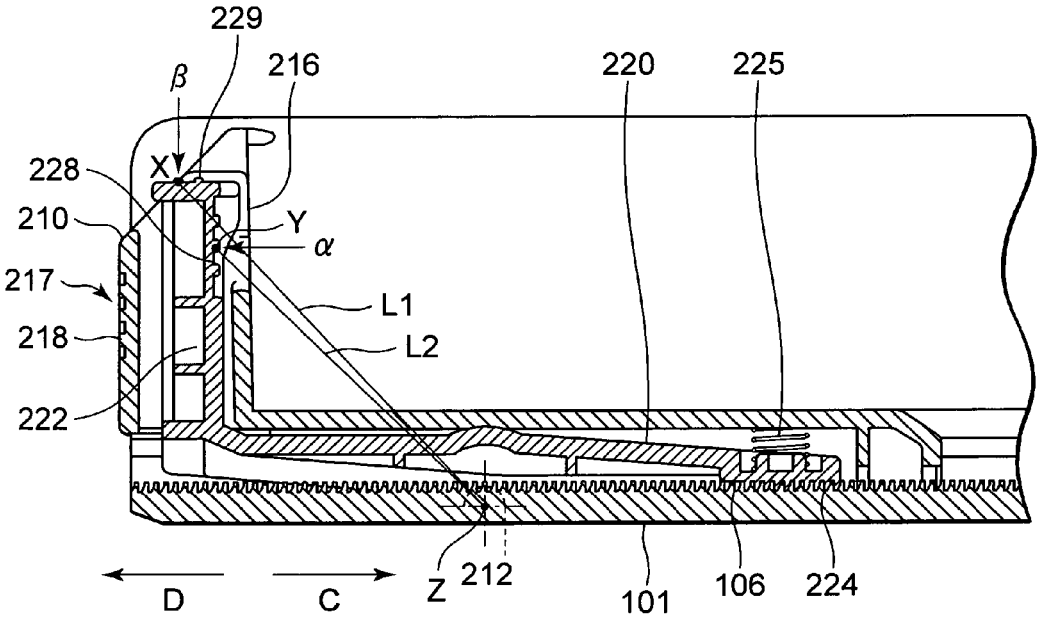
FIG. 7 is a cross-sectional view of the media-loaded device of the first embodiment.

It should be noted that the locations of the handling portions 228 and 229 are not limited to the locations shown in FIG. 6A. Specifically, as shown in FIG. 7, assume that the point of effort on the lock lever 220 to which an external force is applied in the direction β is X, the center of the pivot point 212 is Z, and an imaginary line that passes through the point X and the center Z is L1. The upper handling portion 229 may be provided on the lever member 222 so that the direction β is at a predetermined angle other than 0° to the line L1, and so that the lock portion 224 is disengaged from the lock portion 106 by the force. In a similar way, assume that the point of effort on the lock lever 220 to which an external force is applied in the direction α is Y, and an imaginary line that passes through the point Y and the center Z is L2. The side handling portion 228 may be provided on the lever member 222 so that the direction α is at a predetermined angle other than 0° to the line L2, and so that the lock portion 224 is disengaged from the lock portion 106 by the force.

Figure 8:
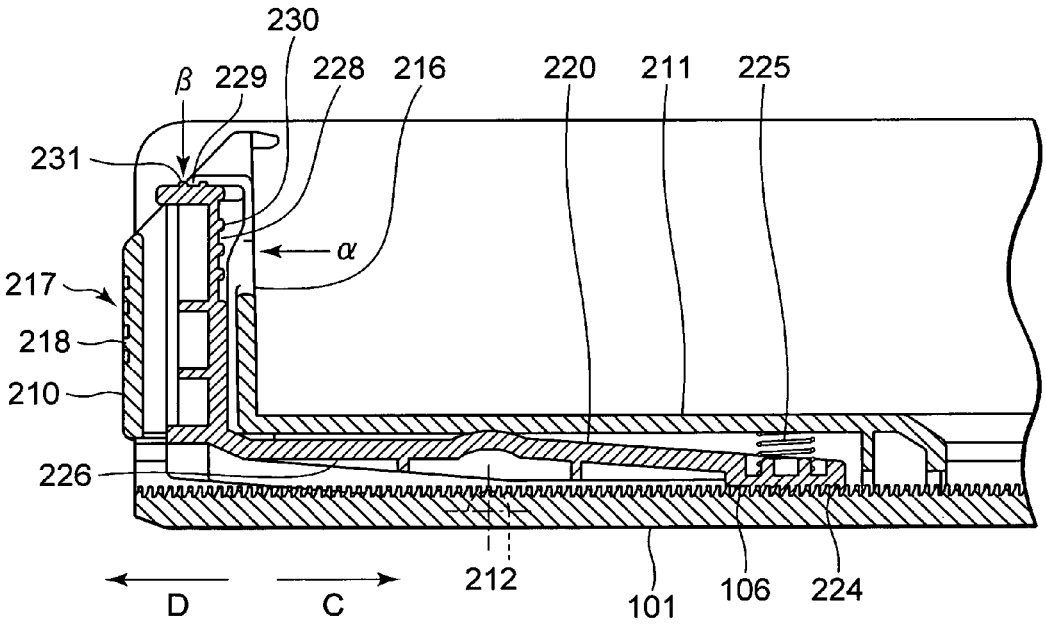
FIG. 8 is a first cross-sectional view of the media-loaded device along a plane B-B in FIG. 2.
Figure 9:
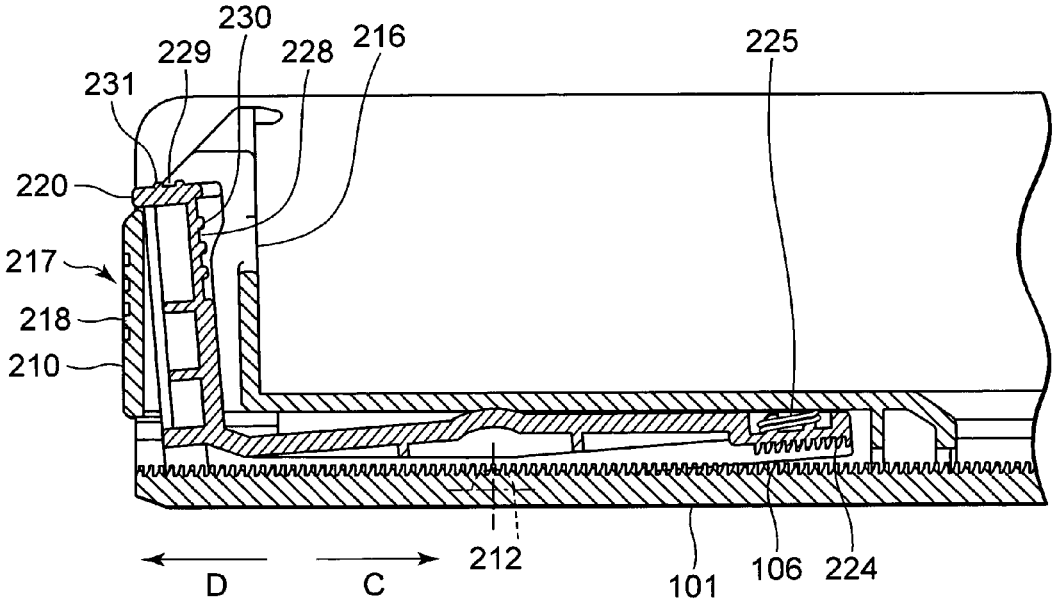
FIG. 9 is a second cross-sectional view of the media-loaded device along the plane B-B in FIG. 2.

FIGS. 8 and 9 are respectively first and second cross-sectional views of the cassette 100 along a plane B-B in FIG. 2. FIG. 8 shows the state where the lock portion 224 of the lock lever 220 engages with the lock portion 106 of the body 101. FIG. 9 shows the state where the lock portion 224 is disengaged from the lock portion 106.

As shown in FIG. 8, the spring 225 always presses the lock portion 224 toward the lock portion 106. Therefore, the lock portion 224 engages with the lock portion 106 in the absence of an external force to the lock lever 220. As a result, the tail guide unit 200 is secured to the body 101. In the state in FIG. 8, when a user presses the side handling portion 228 in the direction α or presses the upper handling portion 229 in the direction β, the lock portion 224 is disengaged from the lock portion 106 as shown in FIG. 9. As a result, the tail guide unit 200 is movable relative to the body.

Figure 10:
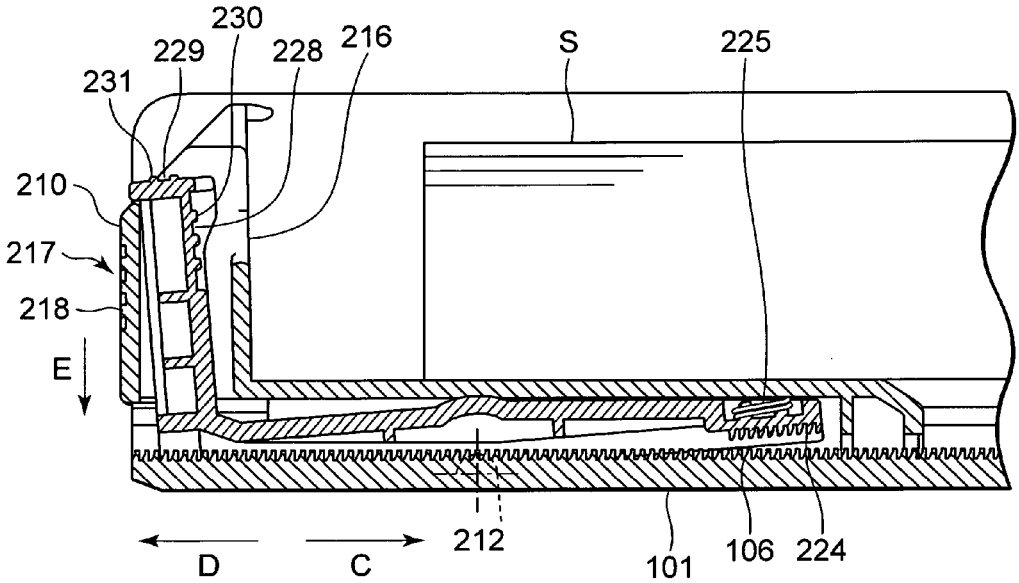
FIG. 10 is a third cross-sectional view of the media-loaded device along the plane B-B in FIG. 2.

Next, an operation of the cassette 100 will be described with reference to FIGS. 8, 9, and 10. FIG. 10 is a third cross-sectional view of the cassette along the plane B-B in FIG. 2. FIG. 10 shows the state where the lock portion 224 is disengaged from the lock portion 106 after sheets S are supplied to the cassette.

In the state in FIG. 8, before sheets are supplied to the cassette 100, a user pinches the handling portion 217 of the tail guide 210 and the side handling portion 228 of the lock lever 220 between his/her fingers, and moves the side handling portion 228 in the direction D. The lock lever 220 pivots about the pivot point 212 in the counterclockwise direction with the movement of the side handling portion 228, and the lock portion 224 is disengaged from the lock portion 106 as shown in FIG. 9. As a result, the tail guide unit 200 is movable in the direction C or D.

In the state in FIG. 9, when the user releases his fingers from the side handling portion 228, the lock lever 220 pivots about the pivot point 212 in the clockwise direction. As a result, the lock portion 224 engages with the lock portion 106, thereby securing the tail guide unit 200 to the body 101.

In the state in FIG. 10, after sheets S are supplied to the cassette 100, the user pinches the handling portion 217 of the tail guide 210 and the upper handling portion 229 of the lock lever 220 between his/her fingers, and presses the upper handling portion 229 in the direction E. The lock lever 220 pivots about the pivot point 212 in the counterclockwise direction with the movement of the upper handling portion 229, and the lock portion 224 is disengaged from the lock portion 106. As a result, the tail guide unit 200 is movable in the direction C. When the user releases his fingers from the upper handling portion 229 after the contact portion 216 of the tail guide unit 200 comes into contact with rear ends of the sheets S, the lock lever 220 pivots about the pivot point 212 in the clockwise direction. As a result, the lock portion 224 engages with the lock portion 106, thereby securing the tail guide unit 200 to the body 101.

As described above, in the first embodiment, the lock portion 224 of the lock lever 220 can be disengaged from the lock portion 106 of the body 101 by an external force applied to the upper handling portion 229 of the lock lever 220. That is to say, the lock portion 224 can be disengaged from the lock portion 106 by an external force applied in a stacking direction of sheets. Therefore, the tail guide unit 200 does not require a clearance for receiving a user's fingers between the lock lever 220 and the sheets, thereby making itself compact. In addition, the tail guide unit 200 can be handled with ease even in the state where the sheets are stacked in the cassette 100.

Moreover, in the lock lever 220, the lever member 226 is at a predetermined angle, e.g., a right angle, to the lever member 222. Therefore, a user can disengage the lock portion 224 from the lock portion 106 by pressing either of the handling portions 228 or 229. That is to say, the lock portion 224 can be disengaged from the lock portion 106 by an external force applied in any of multiple different directions. For instance, the user can move the tail guide unit 200 by pressing the side handling portion 228 in the case where no sheet is loaded in the cassette 100. On the other hand, the user can move the tail guide unit 200 by pressing the upper handling portion 229 in the case where sheets are stacked in the cassette. This enhances the usability of the tail guide unit 200.

Furthermore, in the tail guide unit 200, the pivot point 212 is disposed below the platform 211, and also the lever member 226 and the arm member 227 are disposed below and along the platform. Besides, the lock portion 224 is provided on the undersurface of the arm member 227. This makes the tail guide unit 200 and the cassette 100 more compact.

First Modification

Figure 11:
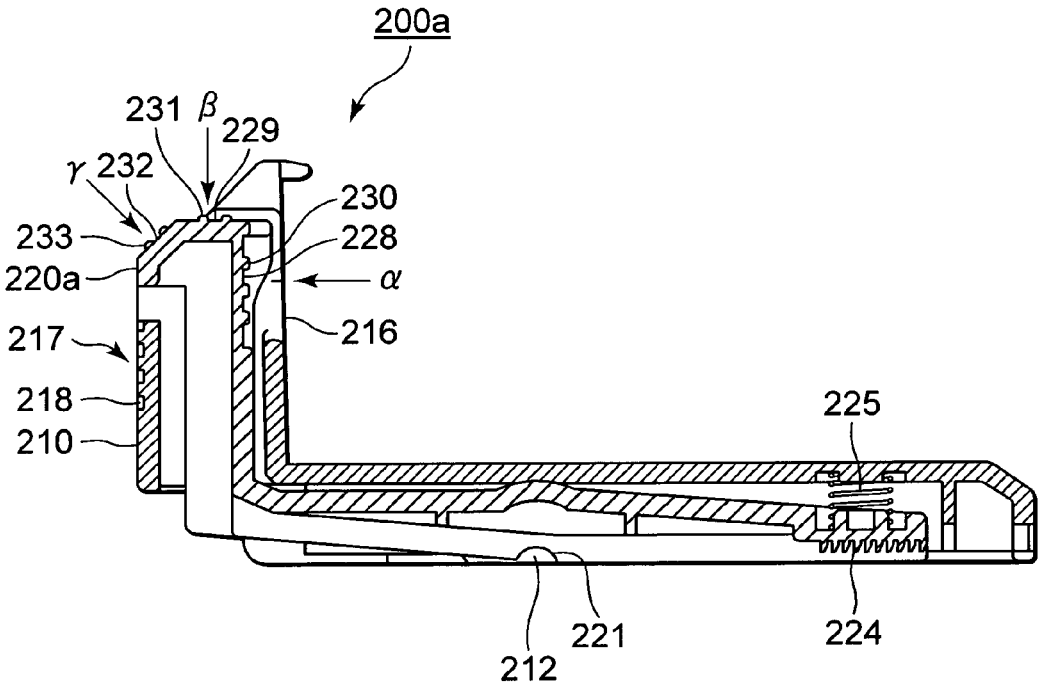
FIG. 11 is a cross-sectional view of a guide unit of a first modification of the first embodiment.

FIG. 11 is a cross-sectional view of a tail guide unit 200*a* of a first modification of the first embodiment. As shown in FIG. 11, a lock lever 220*a*, which serves as a disengaging member, of the first modification includes a sloped handling portion 232 in addition to the same elements as those in the lock lever 220. The handling portion 232 extends obliquely downward from an end of the upper handling portion 229. The handling portion 232 has a concave-convex portion 233 that prevents the fingers of a user from slipping when he/she handles the lock lever 220*a*.

As is the case with the first embodiment, in the first modification, when a user presses the side handling portion 228 in the direction α or presses the upper handling portion 229 in the direction β, the lock portion 224 of the lock lever 220*a* is disengaged from the lock portion 106 of the body 101. In addition to this, when the user presses the handling portion 232 in the direction γ, the lock portion 224 is disengaged from the lock portion 106.

Second Modification

Figure 12:
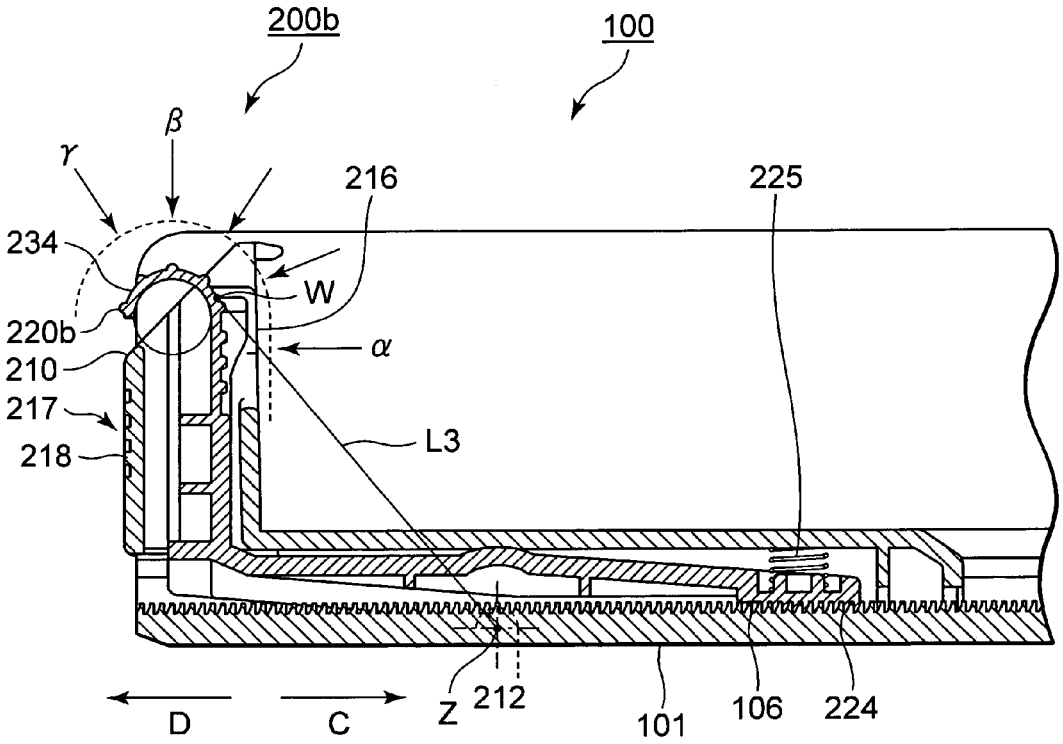
FIG. 12 is a cross-sectional view of a media-loaded device including a guide unit of a second modification of the first embodiment.

FIG. 12 is a cross-sectional view of a sheet cassette 100 including a tail guide unit 200*b* of a second modification of the first embodiment. As shown in FIG. 12, a lock lever 220*b*, which serves as a disengaging member, of the second modification includes a circular handling portion 234 in place of the handling portions 228, 229, and 232 of the first modification.

In the second modification, when a user presses the handling portion 234 in any of multiple different directions including the directions α, β, and γ, the lock portion 224 of the lock lever 220*b* is disengaged from the lock portion 106 of the body 101. In the tail guide unit 200*b*, assume that the point of effort on the lock lever 220*b* to which an external force is applied is W, the center of the pivot point 212 is Z, and an imaginary line that passes through the point W and the center Z is L3. The handling portion 234 could then be provided so that a direction in which the external force is applied is at a predetermined angle other than 0° to the line L3, and so that the lock portion 224 is disengaged from the lock portion 106 by the force.

Third Modification

Figure 13:
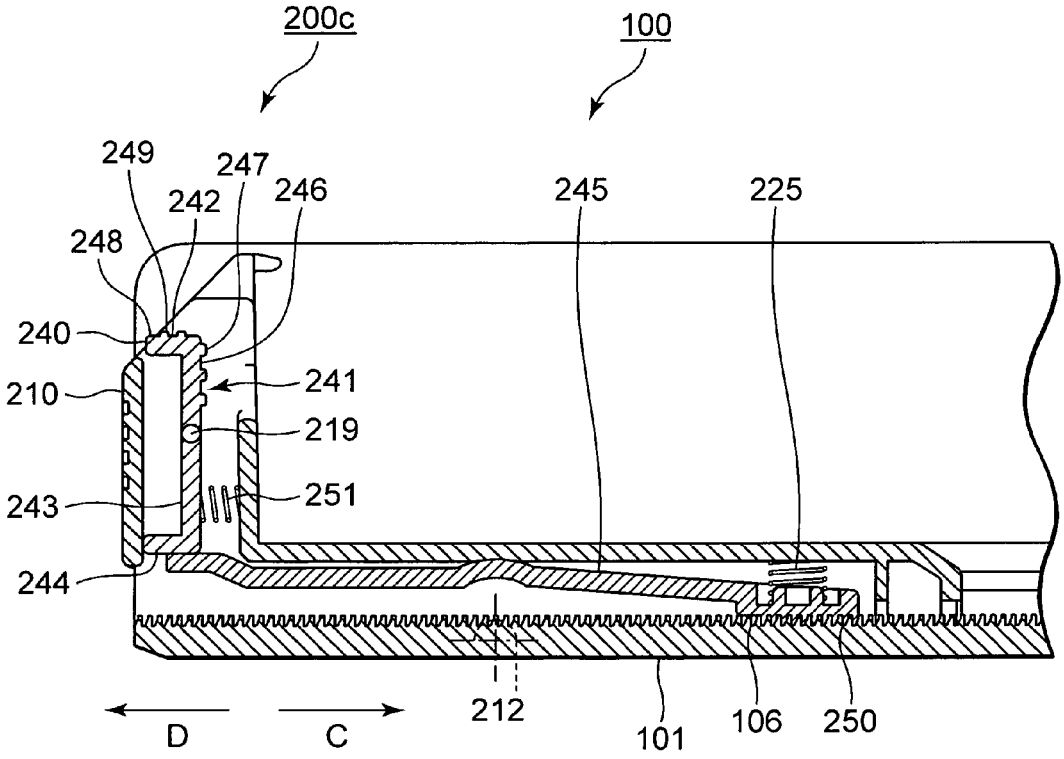
FIG. 13 is a first cross-sectional view of a media-loaded device including a guide unit of a third modification of the first embodiment.
Figure 14:
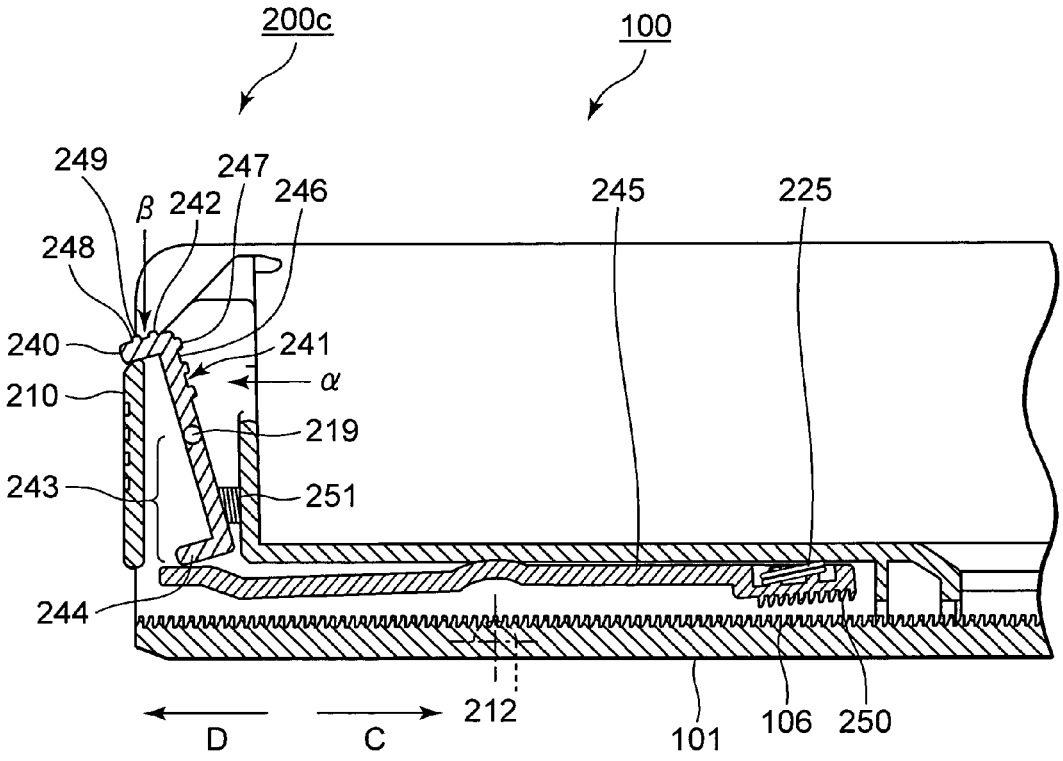
FIG. 14 is a second cross-sectional view of the media-loaded device including the guide unit of the third modification of the first embodiment.

FIGS. 13 and 14 are respectively first and second cross-sectional views of a sheet cassette 100 including a tail guide unit 200*c* of a third modification of the first embodiment. As shown in FIGS. 13 and 14, a lock lever 240, which serves as a disengaging member, of the third modification includes lever members 241, 242, 243, and 244, and an arm member 245.

A pivot point 219 is located at one end of the lever member 241, which serves as a first member. The lever member 242, which serves as a second member, is formed at the other end of the lever member 241. The lever members 241 and 242 respectively have a side handling portion 246 and an upper handling portion 248. The handling portions 246 and 248 respectively have concave-convex portions 247 and 249 that prevent the fingers of a user from slipping when he/she handles the lock lever 240. In the third modification, the lever member 242 is at a predetermined angle to the lever member 241.

The pivot point 219 is also located at one end of the lever member 243, which serves as a third member. The lever member 244, which serves as a fourth member, is formed at the other end of the lever member 243. The lever member 244 is in contact with one end of the arm member 245. The arm member 245 has a lock portion 250, which serves as a second engaging member, at the other end thereof, and pivots about the pivot point 212 of the tail guide 210.

As shown in FIG. 13, when no external force is applied to the lock lever 240, i.e., when the lock portion 250 engages with the lock portion 106 of the body 101, the lever member 243 is pressed in the direction D by a spring 251. As a result, an end of the lever member 244 comes into contact with an inner wall of the tail guide 210.

As shown in FIG. 14, when a user presses the side handling portion 246 in the direction α or presses the upper handling portion 248 in the direction β, the lever members 241, 242, 243, and 244 pivot about the pivot point 219 in the counterclockwise direction. The lever member 244 pushes down the end of the arm member 245, and consequently the lock portion 250 is disengaged from the lock portion 106.

Second Embodiment

Figure 15:
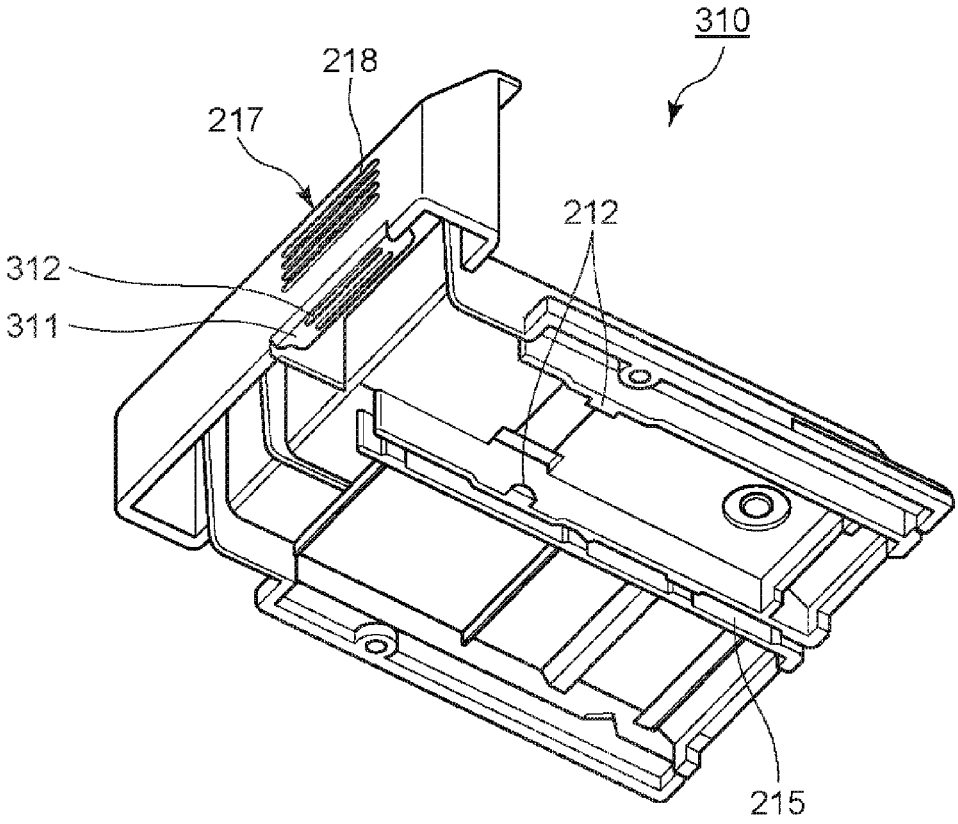
FIG. 15 is a perspective view of a regulation member of a second embodiment.
Figure 16:
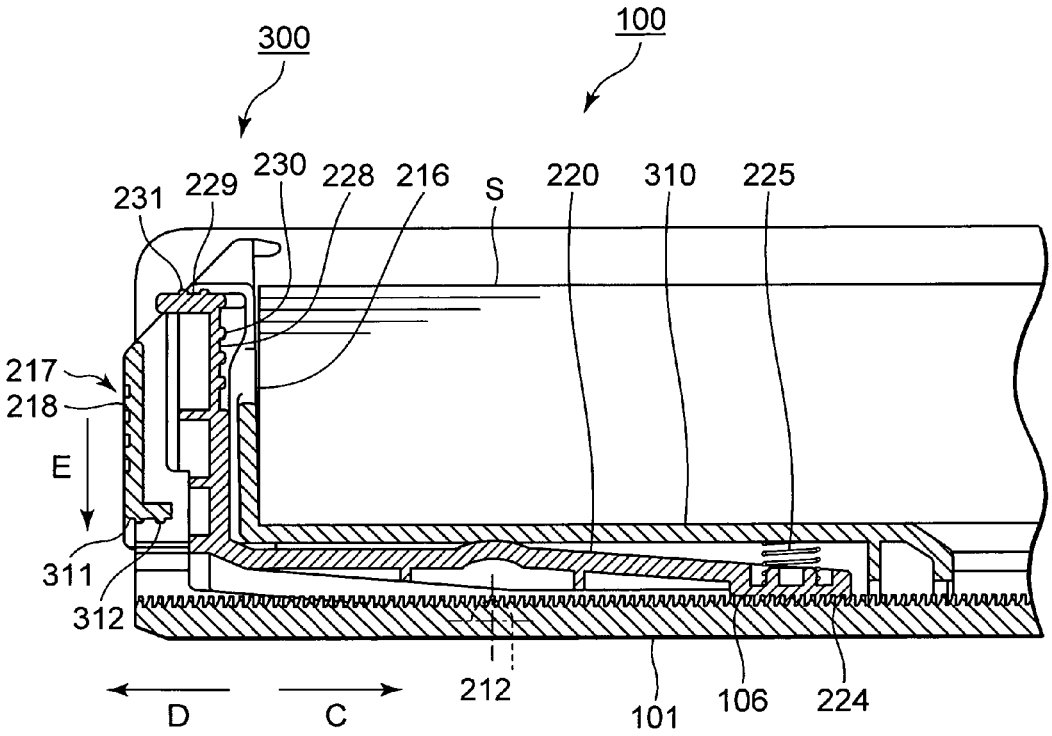
FIG. 16 is a cross-sectional view of a media-loaded device including a guide unit of the second embodiment.

FIG. 15 is a perspective view of a tail guide 310 of a second embodiment. FIG. 16 is a cross-sectional view of a sheet cassette 100 including a tail guide unit 300 of the second embodiment. In the second embodiment, elements similar to those in the first embodiment have been given the same numerals and their description is partially omitted.

As shown in FIGS. 15 and 16, the tail guide 310, which serves as a regulation member, includes a lower handling portion 311 in addition to the same elements as those in the tail guide 210 of the first embodiment. The lower handling portion 311, which is provided below the handling portion 217, is at substantially a right angle to the handling portion 217. The lower handling portion 311 has a concave-convex portion 312 that prevents the fingers of a user from slipping when he/she handles the tail guide 310.

Referring to FIG. 16, in the state where sheets S are stacked in the cassette 100, a user pinches the lower handling portion 311 of the tail guide 310 and the upper handling portion 229 of the lock lever 220 between his/her fingers, and presses the upper handling portion 229 in the direction E. The lock lever

220 pivots about the pivot point 212 of the tail guide 310 in the counterclockwise direction with the movement of the upper handling portion 229, and the lock portion 224 is disengaged from the lock portion 106. As a result, the tail guide unit 300 is movable in the direction D.

As described above, in the second embodiment, the lower handling portion 311 is provided below the handling portion 217, and is at substantially a right angle to the handling portion 217. Therefore, the tail guide unit 300 can further enhance its usability in the state where sheets are stacked in the cassette 100.

In each of the embodiments, the detailed description was given with respect to a tail guide unit, which regulates the position of sheets in the feed direction, by way of example. However, this invention may also be applicable to a side guide unit, which regulates the position of sheets in a direction perpendicular to the feed direction.

While each of the embodiments has been described with respect to an electrophotographic printer, the invention may also be applicable to a copier, a facsimile machine, or a multifunction peripheral (MFP).

The media-loaded device and the image forming apparatus being thus described, it will be apparent that the same may be varied in many ways. Such variations are not to be regarded as a departure from the spirit and scope of the invention, and all such modifications as would be apparent to one of ordinary skill in the art are intended to be included within the scope of the following claims.

What is claimed is:

1. A media-loaded device, comprising:

a main body in which media are stackable and that has a first engaging member; and a guide unit configured to be movable relative to the main body, and that has a regulation member and a disengaging member, wherein the regulation member regulates position of the media, the regulation member having a receiving platform configured to receive the media thereon, a contact portion configured to come into contact with ends of the media, and a pivot point disposed below and along the receiving platform, wherein the disengaging member pivots about the pivot point relative to the regulation member, the disengaging member having a second engaging member configured to engage with the first engaging member, a handling portion configured to be operated by a user, a first member, a second member configured to be at a predetermined angle to the first member, and an arm member extending from the second member, wherein the second engaging member, the handling portion, the first member, the second member and the arm member are integrally formed, the second engaging member being disposed on the arm member, the handling portion being disposed on the first member, the second member being disposed between the receiving platform and the pivot point, and wherein the second engaging member is disengaged from the first engaging member by an external force applied downward on the handling portion in a stacking direction of the media that is a direction substantially perpendicular to a surface of the receiving platform on which the media are stacked.

2. The media-loaded device according to claim 1, wherein the first member extends along the contact portion.

3. The media-loaded device according to claim 1, wherein the regulation member has a pivot-restricting member configured to abut the first member, and the guide unit has a pressure member configured to press the second engaging member toward the first engaging member.

4. The media-loaded device according to claim 1, wherein the handling portion has a concave-convex portion.

5. The media-loaded device according to claim 1, wherein the regulation member has another handling portion on a side opposite to the contact portion.

6. An image forming apparatus comprising the media-loaded device according to claim 1.

7. The media-loaded device according to claim 1, wherein an axial direction of the pivot point is horizontal.

8. The media-loaded device according to claim 1, wherein an axial direction of the pivot point is parallel to a surface of the receiving platform that touches the media.

9. The media-loaded device according to claim 1, wherein the first member and the second member extend in directions that are substantially 90 degrees apart.

10. The media-loaded device according to claim 1, wherein the second engaging member is disposed at an underside of the arm member.

* * * * *